US006918803B2

(12) United States Patent
Shomura

(10) Patent No.: US 6,918,803 B2
(45) Date of Patent: Jul. 19, 2005

(54) OUTBOARD MOTOR

(75) Inventor: Nobuyuki Shomura, Shizuoka (JP)

(73) Assignee: Suzuki Motor Corporation, Shizuoka (JP)

( * ) Notice: Subject to any disclaimer, the term of this patent is extended or adjusted under 35 U.S.C. 154(b) by 0 days.

(21) Appl. No.: 10/624,875

(22) Filed: Jul. 21, 2003

(65) Prior Publication Data

US 2004/0029461 A1 Feb. 12, 2004

(30) Foreign Application Priority Data

Aug. 6, 2002 (JP) ..... 2002-229090

(51) Int. Cl.[7] ..... B63H 21/38; F02M 3/00

(52) U.S. Cl. ..... 440/88 A; 440/84; 440/87; 123/339.1

(58) Field of Search ..... 440/88 R, 1, 2, 440/84, 87, 88 A; 123/319, 339.1, 339.12–339.18, 339.23–339.28

(56) References Cited

U.S. PATENT DOCUMENTS 5,115,784 A * 5/1992 Mito et al. ..... 123/516
5,265,571 A * 11/1993 Sodeno ..... 123/339.17
5,364,322 A * 11/1994 Fukui ..... 477/108
6,015,319 A * 1/2000 Tanaka ..... 440/84
6,079,389 A * 6/2000 Ono et al. ..... 123/352
6,098,591 A * 8/2000 Iwata ..... 123/339.11
6,375,525 B1 * 4/2002 Kanno ..... 440/87
6,415,766 B1 * 7/2002 Kanno et al. ..... 123/339.19
6,446,599 B1 * 9/2002 Nakayasu ..... 123/339.23
6,470,852 B1 * 10/2002 Kanno ..... 123/339.23
6,474,298 B2 * 11/2002 Kanno ..... 123/339.14
6,481,411 B1 * 11/2002 Katayama ..... 123/339.23
6,491,032 B1 * 12/2002 Kanno ..... 123/680
6,520,147 B1 * 2/2003 Kanno ..... 123/339.23
6,543,429 B2 * 4/2003 Osakabe et al. ..... 123/585
6,612,882 B2 * 9/2003 Shidara et al. ..... 440/1
6,672,283 B2 * 1/2004 Kanno ..... 123/406.59
6,733,351 B2 * 5/2004 Mashiko ..... 440/88 A
6,738,708 B2 * 5/2004 Suzuki et al. ..... 701/110
2004/0020461 A1 * 2/2004 Miyashita et al. ..... 123/399

FOREIGN PATENT DOCUMENTS

JP 56141044 A * 11/1981 ..... F02M/7/24
JP 04265453 A * 9/1992 ..... F02M/7/26
JP 2002047978 A * 2/2002 ..... F02D/41/08
JP 2000291470 A * 10/2002 ..... F02D/41/08

* cited by examiner

*Primary Examiner*—Andrew D. Wright
*Assistant Examiner*—Ajay Vasudeva
(74) *Attorney, Agent, or Firm*—Darby & Darby

(57) ABSTRACT

An outboard motor in which a location on a hull of a throttle operating unit (81) such as a throttle lever and a location on the hull of an outboard motor main body accommodating therein an engine are positioned away from each other on the hull and in which a control inputted by a crew member to the throttle operating unit is mechanically transmitted to a throttle valve of the engine accommodated in the outboard motor main body so as to drive the throttle valve to be opened and closed, the outboard motor being characterized in that an electric air control valve (14) for increasing and decreasing the volume of intake air to the engine via a separate system from the throttle valve and a control unit including an actuator for controlling the opening and closing of the air control valve 14 are provided on the engine accommodated in the outboard motor main body, and in that an engine speed operating unit (44, 46) is provided by which the crew member directly inputs an air increase or decrease signal into the control unit of the electric air control valve (14).

18 Claims, 15 Drawing Sheets

FIG. 3A

| ENGINE SPEED | 600 | 1000 | 2000 | 3000 | 4000 | 5000 | 6000 |
|---|---|---|---|---|---|---|---|
| CONTROL VOLUME | 10% | 50% | 50% | 50% | 75% | 100% | 100% |

FIG. 3B

| ENGINE SPEED | 600 | 1000 | 2000 | 3000 | 4000 | 5000 | 6000 |
|---|---|---|---|---|---|---|---|
| CONTROL VOLUME | 10% | 30% | 50% | 60% | 100% | 100% | 100% |

OUTBOARD MOTOR

BACKGROUND OF THE INVENTION

The present invention relates to an outboard motor in which a throttle valve equipped on an outboard motor main body is driven to be opened and closed from a throttle operation unit in a cockpit of a boat via a long throttle cable.

Conventionally, when an outboard motor is mounted to the hull of a boat, a distance from the cockpit to the engine becomes long in comparison with an engine unit for a motorcycle or engine unit for an automobile. In general, a throttle valve (a throttle body, a carburetor) equipped on the outboard motor is designed to be operated and driven (to be opened and closed) from a throttle operation unit (a remote control box) in the cockpit of a hull via a throttle cable which is 5 meters or longer.

The throttle cable is in general constituted by an outer cable and an inner cable which is slidably inserted through the outer cable, and the sliding resistance between the outer cable and the inner cable changes depending on the length of the throttle cable and the number of bends along the length of and curvature of the throttle cable.

In the case of the outboard motor, as has been described above, since the throttle cable is long and is laid out in a bent fashion within the hull, the sliding resistance is increased. In addition, since the inner cable extends, the hysteresis in the throttle opening and closing directions becomes large and there is caused difficulty in fine adjustment of throttle opening.

With the outboard motor, from the aforesaid reason, there is caused a problem that the throttle lever has to be operated a plurality of times in order to make adjustments required to open and close the throttle properly to have a desired boat velocity (engine speed).

SUMMARY OF THE INVENTION

The present invention was made in view of the problem inherent in the aforesaid conventional outboard motor, and an object thereof is to provide an outboard motor in which the throttle can be finely adjusted without operating the throttle lever a plurality of times even if the cockpit on the hull and the outboard motor are located away from each other.

With a view to solving the problem, the invention has the following aspects.

According to the invention, there is provided an outboard motor in which a location on a hull of a throttle operating unit by which a crew member controls the opening of a throttle valve for controlling the volume of intake air to an engine and a location on the hull of an outboard motor main body accommodating therein the engine are positioned away from each other on the hull and in which a control inputted by the crew member to the throttle operating unit is mechanically transmitted to the throttle valve of the engine accommodated in the outboard motor main body via a wire so as to drive the throttle valve to be opened and closed, the outboard motor being characterized in that an electric air control valve for increasing and decreasing the volume of intake air to the engine via a separate system from the throttle valve and a control unit including an actuator for controlling the opening and closing of the air control valve are provided on the engine accommodated in the outboard motor main body, and in that an engine speed operating unit is provided by which the crew member directly inputs an air increase or decrease signal into the control unit of the electric air control valve.

According to the invention, the engine speed operating unit is preferably made to be a push switch for outputting an air increase or decrease signal through a pushing operation. The push switch can be constructed to be operated using a push switch for increasing the engine speed or air volume and a push switch for decreasing the same. These engine speed UP (increase) push switch and engine speed DOWN (decrease) switch constitute a switch having seesaw type contacts, and it is preferable that the switch is constructed such that both the switches are not turned on simultaneously.

According to the invention, the engine speed operating unit is preferably adapted to control the increase and decrease in air volume through an operation time or the number of times of pushing. The engine speed operating unit may be constructed to change (increase) the air volume when kept pushed for a certain period of time or longer. In addition, a certain increase and decrease in engine speed are predetermined depending on the number of times of pushing (engine speed feedback). The predetermined increase and decrease in engine speed are controlled not by the feedback of an air passage but by the feedback of an increase and decrease in engine speed obtained by an increase and decrease in opening of the air passage. For example, in case the engine speed is predetermined in such a manner as to be increased by 50 rpm through an operation of the UP (Upwards) switch, an increase in opening of the air passage can be determined such that the engine speed is increased by 50 rpm while detecting the engine speed when the UP switch is operated.

According to the invention, an alarm unit is preferably provided which is adapted to be actuated when a control signal inputted from the engine speed operating unit exceeds a control range set for the air control valve. A monitor and a buzzer can be used in the alarm unit.

According to the invention, the outboard motor preferably further has a control unit for restoring the air control valve to a predetermined fundamental control value when the throttle valve is controlled by the throttle operating unit. It is preferable that the air control valve is gradually restored to the predetermined fundamental control value.

According to the invention, an air control value of the air control valve is maintained when the throttle valve is controlled in an opening direction in a state in which the air control value of the air control valve is greater than the fundamental control value, whereas the air control value is returned to the fundamental control value when the throttle valve is controlled in a closing direction. In addition, in case the throttle is controlled in the opening direction when the air control value is smaller than the fundamental control value (when a control to one side is implemented by the air control valve), the air control value of the air control valve is returned to the fundamental control value, whereas in case the throttle is controlled in the closing direction, the air control value is maintained.

According to the invention, the air control value of the air control valve is preferably returned to the fundamental control value when an amount of a throttle control is greater than a predetermined value and a change in amount of air by the throttle control is greater than a change in amount of air that is attained by the air control valve.

According to the invention, the engine speed operating unit is preferably adapted to output an air increase or decrease signal utilizing a displacement detection sensor such as a variable resistor or Hall element.

According to the invention, the engine speed operating unit is preferably disposed in the vicinity of the throttle operating unit of a throttle lever. As this occurs, the engine speed operating unit can be disposed on the throttle lever, at a grip portion of the throttle lever or at a peripheral portion of a PTT switch.

According to the invention, the engine speed operating unit is preferably disposed at an appropriate location on the hull or the outboard motor. As this occurs, the engine speed operating unit may take a configuration which can be operated by the foot. A large button switch, tape switch and mat switch may be used. In addition, the engine speed operating unit can be disposed on a tiller handle or the outboard motor main body (a front part thereof). Furthermore, the engine speed operating unit, when of a tiller handle type, can be disposed at the peripheral portion of the PTT switch. Moreover, the engine speed operating unit can be disposed on the hull (an instrument panel, a steering wheel, a side of the hull, floor board).

BRIEF DESCRIPTION OF THE DRAWINGS

FIGS. 3A and 3B are explanatory diagrams showing respective basic maps for air control according to the embodiment;

FIG. 6A showing an example of a time chart resulting when the throttle is operated and the control of air volume by the operation of an UP switch is maintained, FIG. 6B showing an example of a time chart resulting when the throttle is operated and a similar control of air volume is reset;

DETAILED DESCRIPTION OF THE PREFERRED EMBODIMENTS

Embodiments of the invention will be described in detail below based on the accompanying drawings.

Figure 1:
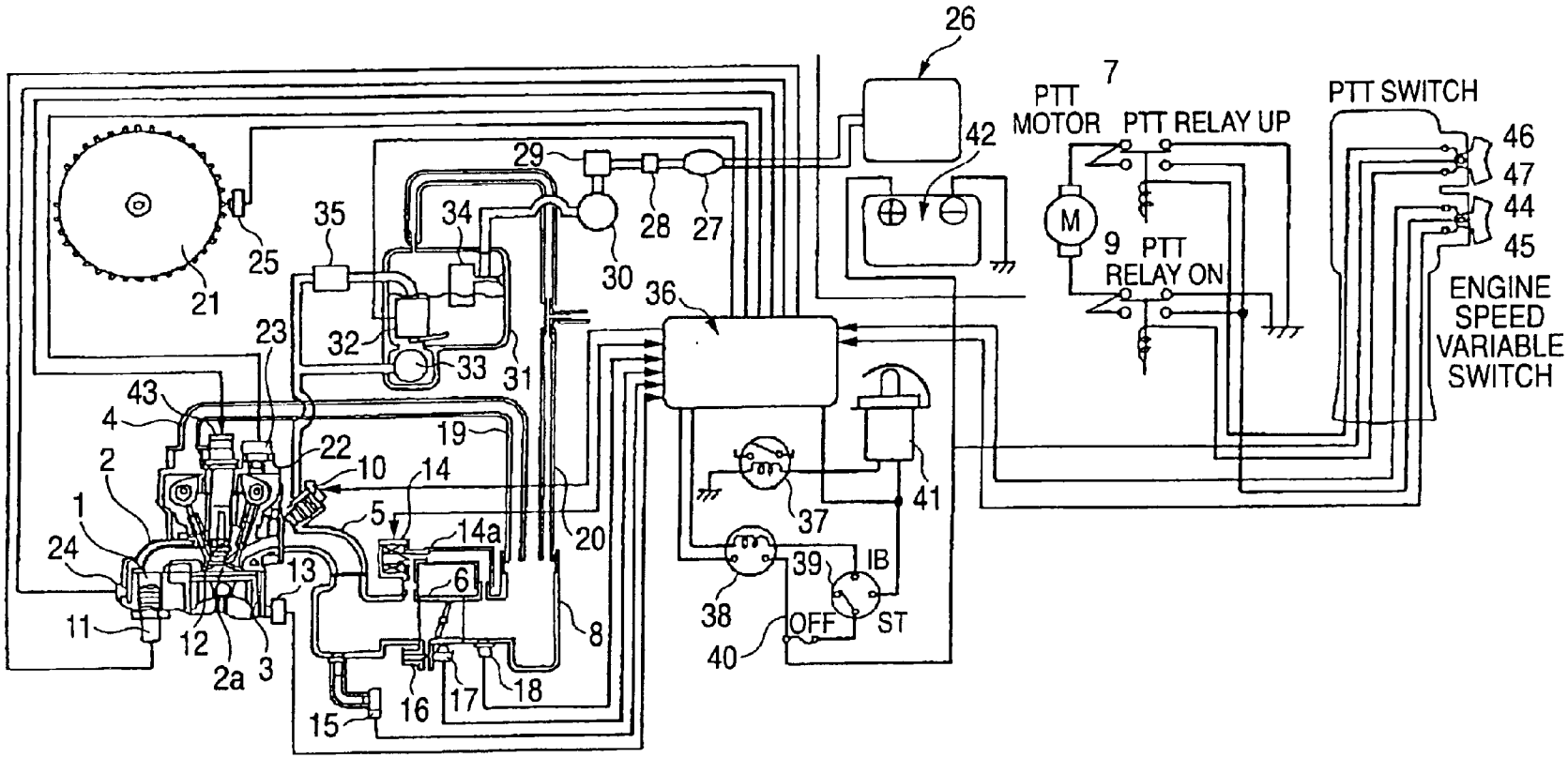
FIG. 1 is a diagram showing an engine control system of an outboard motor according to an embodiment of the invention.
Figure 2:
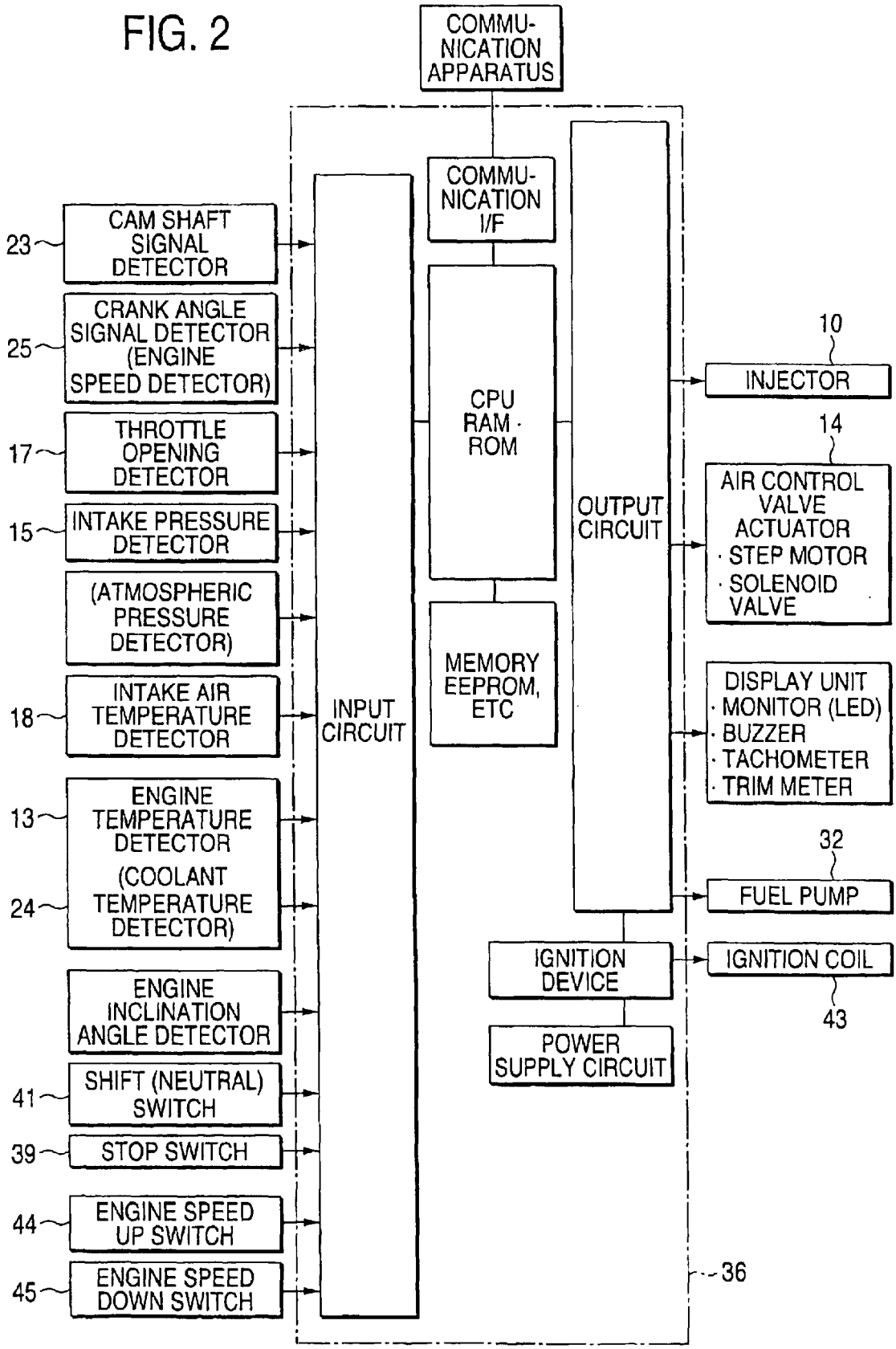
FIG. 2 is a block diagram of the system in FIG. 1.

As shown in FIGS. 1, 2, in an engine of an outboard motor according to the embodiment, an exhaust passage 1 extends from a cylinder head 2 fastened to an upper portion of a cylinder block 3, and a cylinder head cover 4 is mounted on the cylinder head 2 so as to cover a camshaft and a valve. A throttle body 6 accommodating therein a throttle valve is caused to communicate with an upstream side of an intake manifold 5 which is disposed on an intake side of the cylinder head 2, and a silencer 8 is provided upstream of the throttle body 6.

An injector 10 for injecting fuel towards an intake passage within the cylinder head is installed on the intake manifold 5, and on the other hand, an oxygen ($O_2$) sensor 11 is installed in the exhaust passage 1. A sparking plug (an ignition plug) 12 is screwed into the cylinder head 2 in such a manner as face a combustion chamber 2*a* for ignition of an air-fuel mixture. In addition, a temperature sensor 13 for detecting the temperature of a cylinder is installed in a cylinder side wall portion of the cylinder block 3.

A passage bypassing a throttle valve to divert intake air directed to the throttle valve is provided to extend from an upstream portion to a downstream portion of the throttle body 6, and an air volume regulating valve (an air control valve) 14 is provided in the bypass passage for opening and closing the bypass passage so as to regulate and control the flow of intake air. In addition, an intake pressure sensor 15 is provided on a downstream side of the throttle valve for detecting an intake pressure (a vacuum). Note that a pilot air regulator valve 16 and a throttle (opening) sensor 17 are provided on the downstream side of the throttle valve in the throttle body 6. Furthermore, an intake air temperature sensor 18 is provided on an upstream side of the throttle valve.

Connected to an intake side of the silencer 8 are blow-by hose 19 for passing a blow-by gas within the cylinder head cover 4 to the intake side and an evaporation hose 20 for allowing evaporated gases in a vapor separator 31 to flow to the intake side.

A flywheel magnet 21 is rotatably fixed to a crankshaft of the engine, and a crank angle sensor 25 is provided to face the flywheel magnet 21.

In addition, a cam angle trigger pawl 22 of the engine camshaft is disposed, and a cam angle sensor 23 is provided to face the trigger pawl 22. A coolant temperature sensor 24 is provided in an engine water jacket (a coolant passage).

In medium- and large-sized outboard motors, a fuel tank 26 is separately disposed on the hull side from an outboard motor main body, and fuel within the fuel tank 26 is sucked out of the tank by a squeeze pump 27 and is sent to the vapor separator 31 via fuel filter 29 by means of a fuel pump 30.

Fuel is sent under pressure from the vapor separator 31 to the injector 10 via a high-pressure filter 35 by means of a high-pressure fuel pump 32, and the pressure of fuel is regulated to a certain pressure by a pressure regulator 33. Fuel is sent to the vapor separator 31 from the fuel pump 30 such that a certain fuel level is maintained in the vapor separator 31 by detecting the fuel level in the separator by means of a float 34. The vapor separator 31 is such as to separate evaporated and suspended gaseous particles from fuel, and gaseous fuel is sucked into the silencer 8 of the intake system via the evaporation hose 20 as has been described previously.

In an electric control system of the engine, signals from the aforesaid respective sensors such as ($O_2$) sensor 11, the cylinder temperature sensor 13, the intake pressure sensor 15, the throttle sensor 17, the intake air temperature sensor 18, the cam angle sensor 23, the coolant temperature sensor 24 and the crank angle sensor 25 are inputted into a control unit 36, and this control unit 36 is such as to control the injection of a fuel and ignition of an air-fuel mixture according to conditions stored on a ROM (read-only memory) and a RAM (random access memory), signals so inputted and a program which will be described later in order to realize an optimum engine condition.

In addition, the control unit 36 is such as to output an opening signal or a closing signal to the air control valve 14, and an engine speed UP (increase) switch 44 and an engine speed DOWN (decrease) switch 45 by which the crew member inputs an air increase signal and an air decrease signal are provided. Additionally, a PTT (Power Tilt Trim) motor for controlling the tilt angle of the outboard motor main body is provided at an appropriate location on the hull so that the motor is controlled by a relay 7 for imparting an UP rotation to the motor when receiving a signal from an ascent (UP) switch 46 and a relay 9 for imparting a DOWN rotation to the motor when receiving a signal from a descent (DOWN) switch 47.

Note that a signal from an ignition switch 39 drives a main relay 38 to thereby supply the power supply from a battery 42 to the control unit 36 via a fuse 40, whereby when starting up the engine, a starter relay 37 is energized on condition that a neutral switch 41 is switched on, and the starting and cranking of the engine can be implemented.

According to the embodiment, as shown in FIGS. 1 and 2, there is provided the outboard motor in which a controlling input by the crew member to the throttle operating unit is mechanically transmitted to the throttle valve of the engine accommodated in the outboard motor main body via the wire cable of several meters so as to drive the throttle valve to be opened and closed, since the location of a throttle operating unit such as a throttle lever 81 by which the crew member controls the opening of the throttle valve for controlling the volume of intake air to the engine and a location the outboard motor main body accommodating therein the engine are positioned away from each other on the hull. In the outboard motor, the electric air control valve 14 for increasing and decreasing the volume of intake air to the engine via the separate system from the throttle valve and the control unit including an actuator for controlling the opening and closing of the air control valve 14 are provided on the engine accommodated in the outboard motor main body, and in that the engine speed operating unit (44, 45) is provided by which the crew member directly inputs an air increase or decrease signal into the control unit of the electric air control valve 14. To be specific, the throttle valve (the throttle body, a carburetor) equipped in the outboard motor is designed to be controlled and driven (to be opened and closed) from the throttle operating unit (the remote control box) in the cockpit on the hull via the throttle cable having a length of 5 meters or longer. The throttle cable is constituted by an outer cable and an inner cable which is slidably inserted through the outer cable, and the sliding resistance between the outer cable and the inner cable changes depending on the throttle cable length, the number of bends along the length of and curvature of the throttle cable. The throttle cable is laid out as illustrated by broken lines in FIG. 11, which will be described later.

Namely, the throttle valve is such as to regulate largely the volume of intake air, whereas the air control valve 14 is such as to regulate the volume of intake air in a smaller regulating volume than a regulating volume in which the throttle valve regulates the volume of intake air. Then, the air control valve 14 controls the volume of air in the passage (the bypass passage 14*a*) communicating with the downstream of the throttle valve by controlling the energization of a step motor or an electromagnetic solenoid, whereby the engine speed can be adjusted (variably).

The volume of air for the air control valve 14 at a normal time is predetermined by, for example, engine speeds. For example, assuming that the control range of the air control valve 14 ranges from 0 to 100%, a basic map for volumes of air to be controlled by the air control valve 14 can be predetermined for engine speeds as shown in FIG. 3A.

In addition to FIG. 3A, as shown in FIG. 3B (another embodiment), the map can be predetermined freely in consideration of a lower limit value for the engine speed at idle and an engine speed compensation at the time of drastic deceleration (an engine speed UP (upward) compensation for the prevention of an engine stall at the time of drastic deceleration).

Next, described below will be a control example 1 for adjusting the engine speed in a case where a push switch is used for the engine speed UP switch 44 and DOWN switch 45. In a flowchart shown in FIG. 4, respective steps 1 and above will be described as S1 and above.

Figure 4:
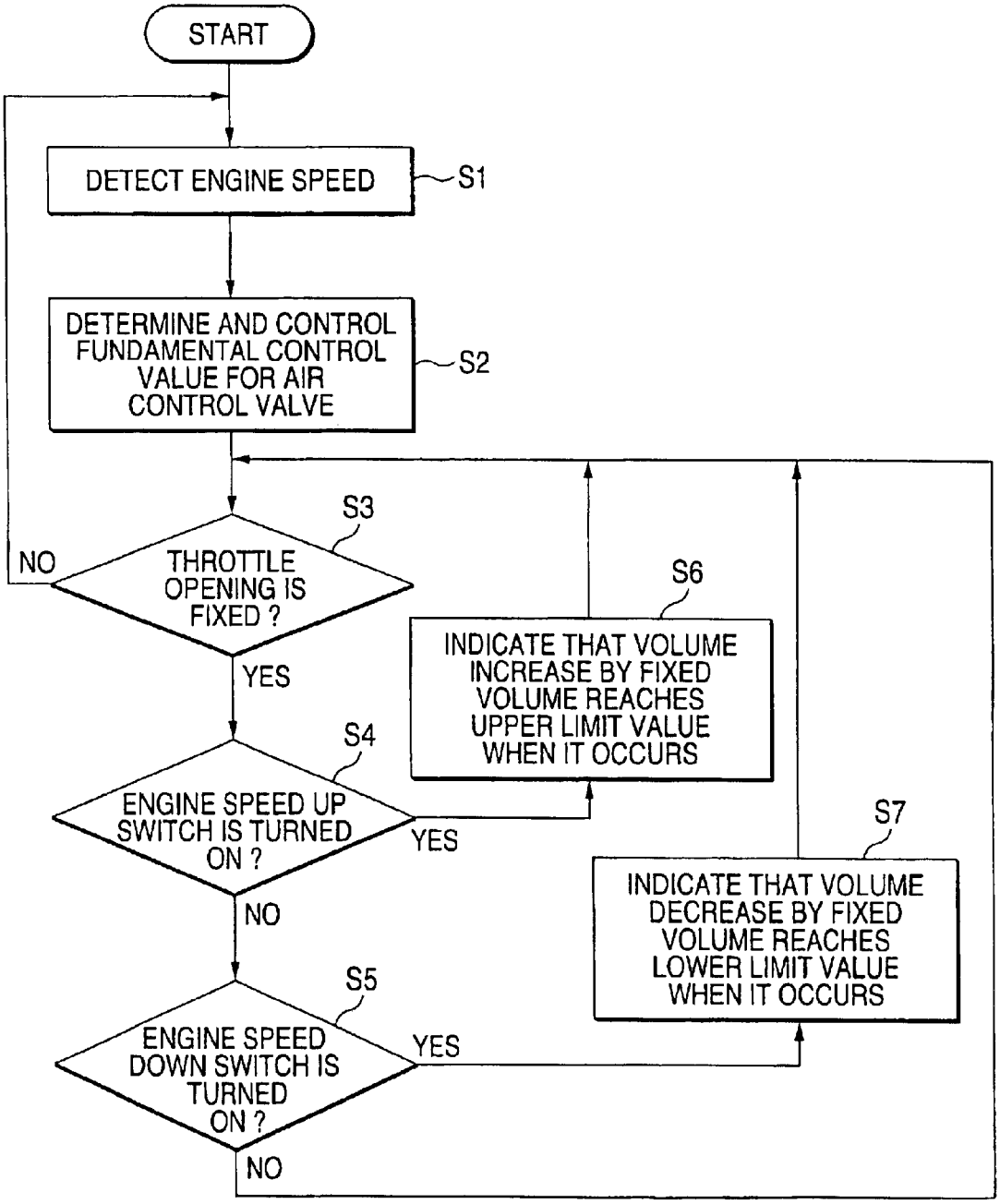
FIG. 4 is a diagram showing an example of a flowchart according to a control example 1 of the embodiment.

As shown in the flowchart in FIG. 4, firstly, an engine speed is detected (S1), and a fundamental control volume for the air control valve 14 is determined from the map (for example, 50%) and the control by the air control valve is implemented (S2).

Next, whether or not there has existed a change in throttle opening is detected. If there has existed no change in throttle opening (the throttle has been fixed) for a certain period of time, enter a control mode according to the embodiment. The detection of a fixation of the throttle is intended to allow for a delay in the follow-up of the engine speed to the operation of the throttle that occurs due to a load after the throttle is operated, and a period of time by which the throttle is fixed can be set arbitrarily by engine speeds.

In the control mode, the operation of the UP switch 44 and DOWN switch 45 is detected at all times (S4, S5), and if the UP switch 44 is detected to be switched on (Yes in S4), the volume of air is increased by a fixed quantity (for example, 5%) (S6). In contrast, if the DOWN switch 45 is detected to be switched on (Yes in S5), the volume of air is decreased by the fixed quantity (for example, 5%) (S7).

In addition, if the switch is detected to be switched on consecutively, the volume of air is increased by a fixed quantity (for example, if the switch is detected to be switched on three times consecutively, the volume of air can be increased or decreased by 10% every detection after the third detection, and if the switch is detected to be switched on five times consecutively, the volume of air is increased or decreased by 20% every detection after the fifth detection.).

Additionally, in a case where the control range of the air control valve 14 is set to range from 0 to 100%, with a controllable capacity (which differs depending on the area of a passage) for the air control valve 14 being small, even if the engine speed UP switch 44 continues to be pushed, a state of 100% control is attained before a desired engine speed is reached, and there may be occurring a case where the desired engine speed cannot be attained only by the control by the air control valve 14. As this occurs, the fact that the desired engine speed is beyond the control range of the air control valve 14 is indicated via a monitor (a meter or the illumination of an LED lamp) or a buzzer (S6, S7). In addition, a control rate (%) during a control can be displayed on the monitor. Thus, the crew member who steers the boat recognizes the controllable range based on what is displayed on the monitor and regulates the engine speed by controlling the throttle in the event that the desired engine speed is beyond the range.

Figure 5:
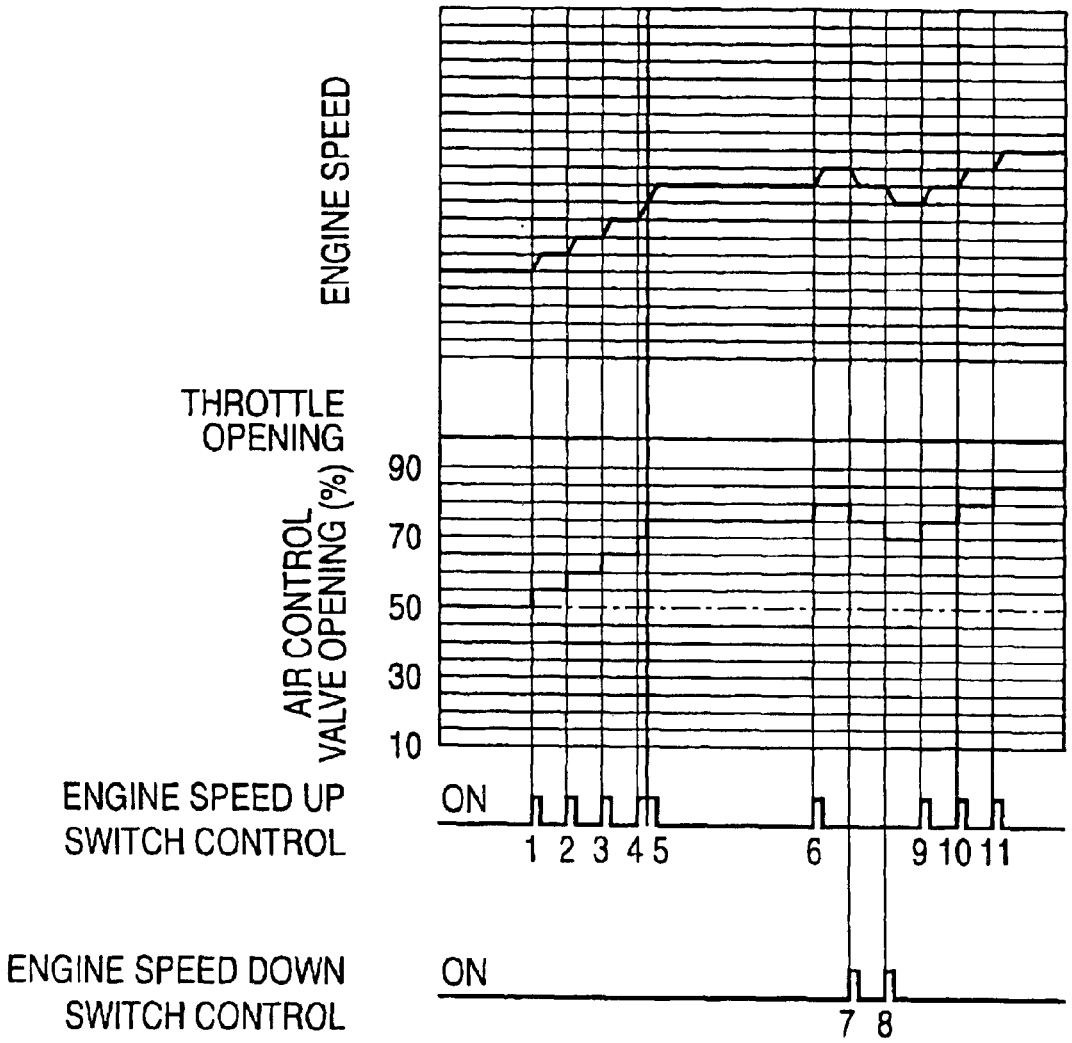
FIG. 5 is a diagram showing an example of a time chart resulting when the volume of air is controlled by a fixed volume through a control according to the embodiment without controlling a throttle.

Next, a controlling operation according to the control example 1 will be described by reference to a time chart shown in FIG. 5. In FIG. 5, since the operation of the engine speed UP switch 44 is effected at "1", "2", "3", "4", "5", "6", "9", "10" and "11", the volume of air controlled by the air control valve 14 is increased by the fixed quantity (for example, 5%) every time the switch is switched on. The engine speed increases according to such operations of the air control valve 14. In particular, at "4" and "5", the switch 44 is detected to be switched on consecutively and the volume of air controlled by the air control valve 14 is increased by 5% for each detection. For example, in case the switch is detected to be switched on three times consecutively, the volume of air increased or decreased every detection after the third detection can be fixed to 10%, and in case the switch is detected to be switched on five times consecutively, the volume of air increased or decreased every detection after the fifth detection can be fixed to 20%.

On the contrary, in the operation of the engine speed DOWN switch 45 in FIG. 5, since there is no throttle operation and the engine speed DOWN switch 45 is switched on at "7", "8", the volume of air controlled by the air control valve is decreased by the fixed quantity (for example, 5%). Thus, the crew member who steers the boat can easily obtain a desired engine speed by operating the UP switch 44 and the DOWN switch 45.

Next, a control example 2 of the air control valve 14 when a throttle control condition is added will be described.

In this control, as has been described previously, in a case where the control range of the air control valve 14 is set to range, for example, 0 to 100%, in the event that the controllable range (which differs depending on the area of a passage) of the air control valve 14 is narrow, even if the engine speed UP switch 44 continues to be pushed, a state of 100% control is attained before a desired engine speed is reached, and therefore, there may be occurring a case where the desired engine speed cannot be attained only by the control of the air control valve 14. As this occurs, the crew member who steers the boat recognizes the controllable range based on what is displayed on the monitor and regulates the engine speed by controlling the throttle in the event that the desired engine speed is beyond the range. The following drawbacks may be caused, respectively, when the control volume of the air control valve is maintained (fixed) (1) and when the control volume is reset to a fixed value of the basic map (2) in controlling the throttle.

(1) Case in which the control volume is maintained: In a case where the control volume of the air control valve is maintained when the throttle opening changes, there may occur a case where the control value of the air control valve 14 deviates to an upper or lower limit side after the throttle has been controlled.

Figure 6A:
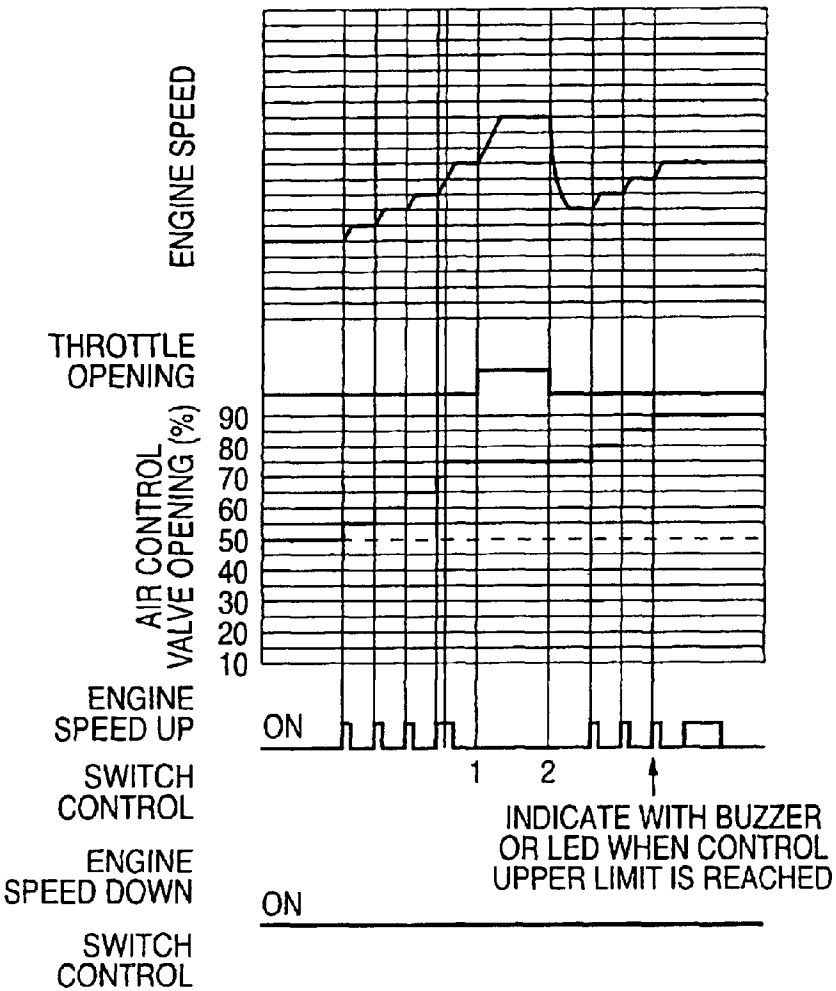
FIGS. 6A and 6B show controls according to the embodiment.

For example, in FIG. 6A, while the throttle is opened at position 1 and is closed at position 2, the control volume of the air control valve 14 is maintained for both the operations. In this case, since the numbers of times of operations of the switches, respectively, on the UP side and the DOWN side before the throttle is controlled are reflected after the throttle is controlled, in FIG. 6A, the control value of the air control valve 14 after the throttle is controlled is offset to an upper limit value, and an engine speed regulating width on the engine speed UP side is reduced.

Figure 8A:
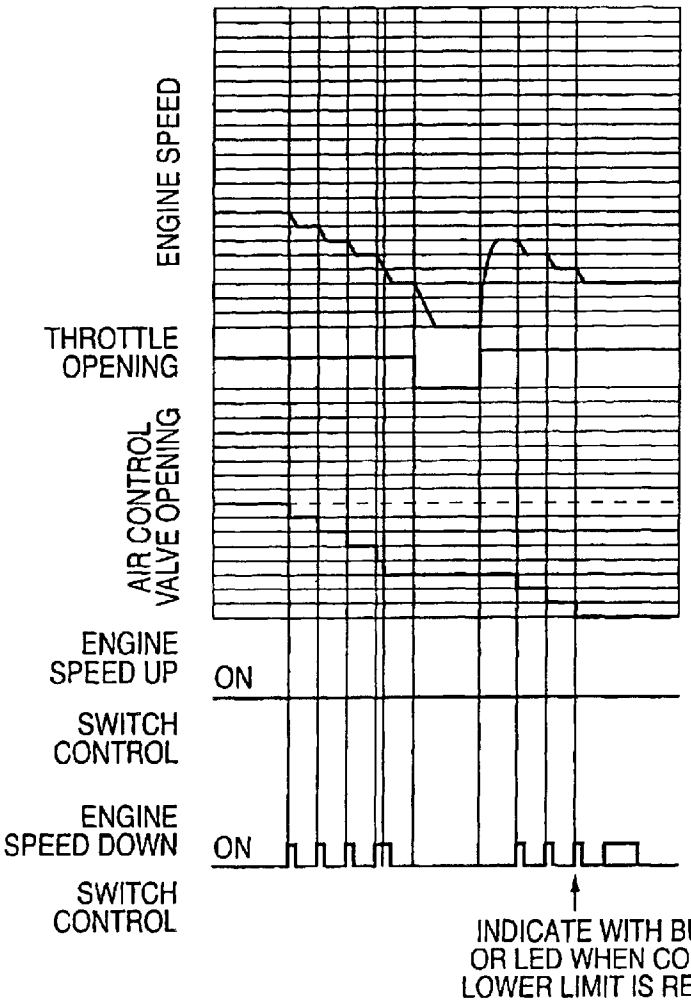
FIGS. 8A and 8B show controls according to the embodiment, FIG. 8A showing an example of a time chart resulting when the throttle is operated and a control of air by the operation of a DOWN switch is maintained, FIG. 8B showing an example of a time chart resulting when the throttle is operated and a similar control of air volume is reset.

On the contrary, as shown in FIG. 8A, in case the control value of the air control valve 14 is offset to a lower limit side, an engine speed regulating width on the engine speed descent side is reduced.

Figure 6B:
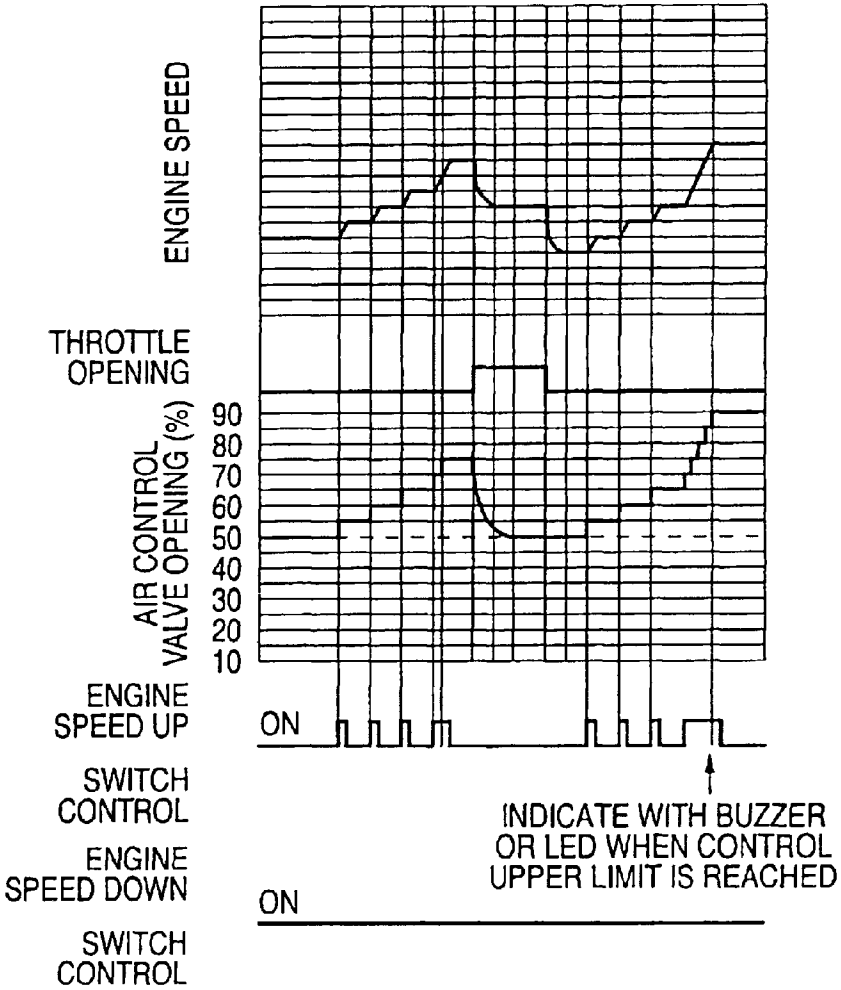

(2) Case in which the control volume is reset to the fundamental control volume when the throttle is controlled with a view to resolving the drawbacks: In this case, since the control volume of the air control valve 14 is reset to the fundamental volume of the map (basically, 50%) when the throttle is controlled, an equal regulating width can be secured on both the ascent (UP) side and descent (DOWN) side at all times after the throttle is controlled, whereby the drawback can be prevented. However, as shown in FIG. 6B, when the control volume is reset to the fundamental control volume also in the event that the throttle is opened by a minute amount after it has been adjusted several times to the engine speed UP side, since a volume of air that is decreased by resetting the control volume (for example, from 75% down to 50%) is larger than a volume of air that is increased by opening the throttle, there is caused a drawback that the engine speed continues to be decreased irrespective of the opening of the throttle, whereby the crew member who steers the boat is made to feel a great physical disorder.

Figure 8B:
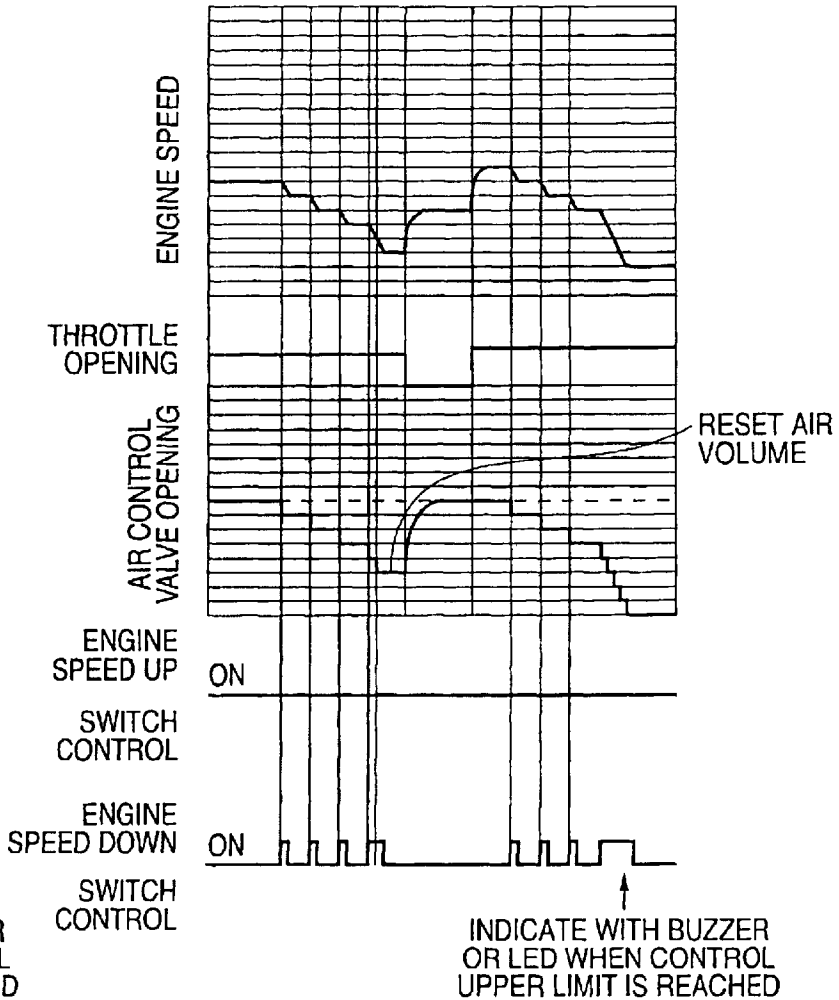

On the contrary, as shown in FIG. 8B, when the control volume is reset to the fundamental control volume also in the event that the throttle is closed by a minute amount after it has been adjusted several times to the engine speed DOWN side, since a volume of air that is increased by resetting the air control valve 14 (for example, from 25% up to 50%) is larger than a volume of air that is decreased by closing the throttle, there is caused a drawback that the engine speed continues to be increased irrespective of the closing of the throttle, whereby the crew member who steers the boat is made to feel a great physical disorder.

Figure 7A:
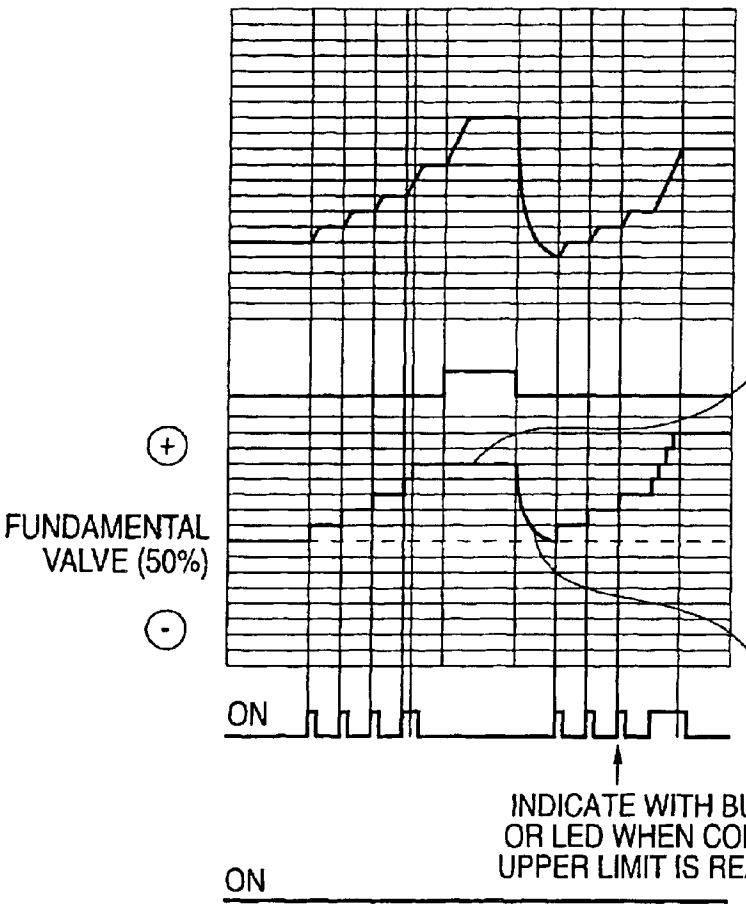
FIGS. 7A and 7B show controls according to the embodiment, FIG. 7A showing an example of a time chart of a control implemented when the throttle is operated and an air control value is greater than a fundamental volume, FIG. 7B showing an example of a time chart of a control implemented when the throttle is operated and the volume of air by the operation of the throttle is sufficiently greater than the control of the volume of air.
Figure 7B:
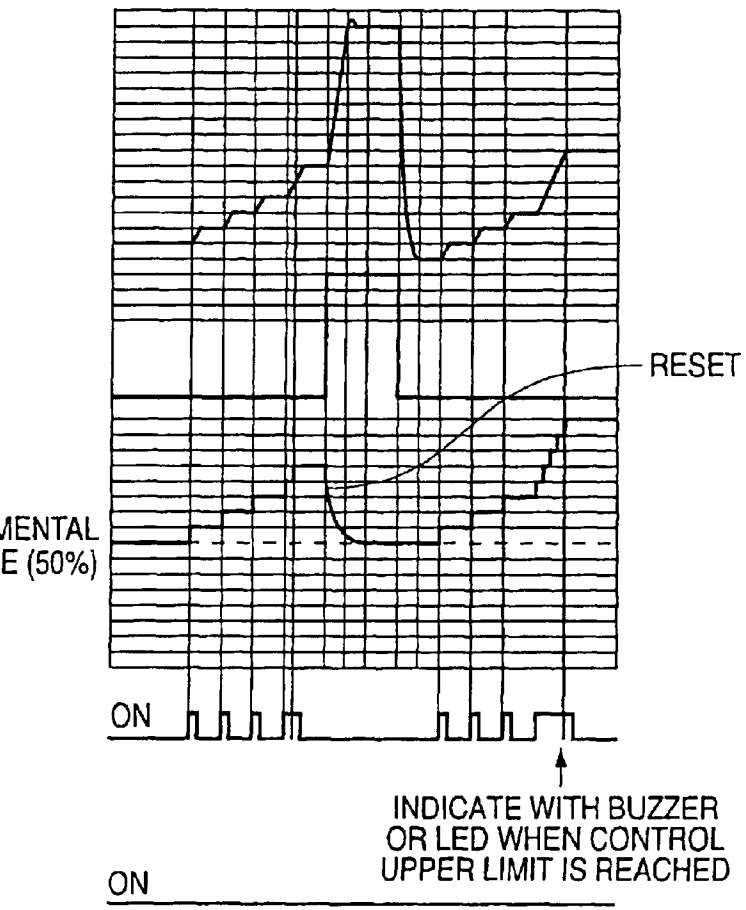
Figure 9:
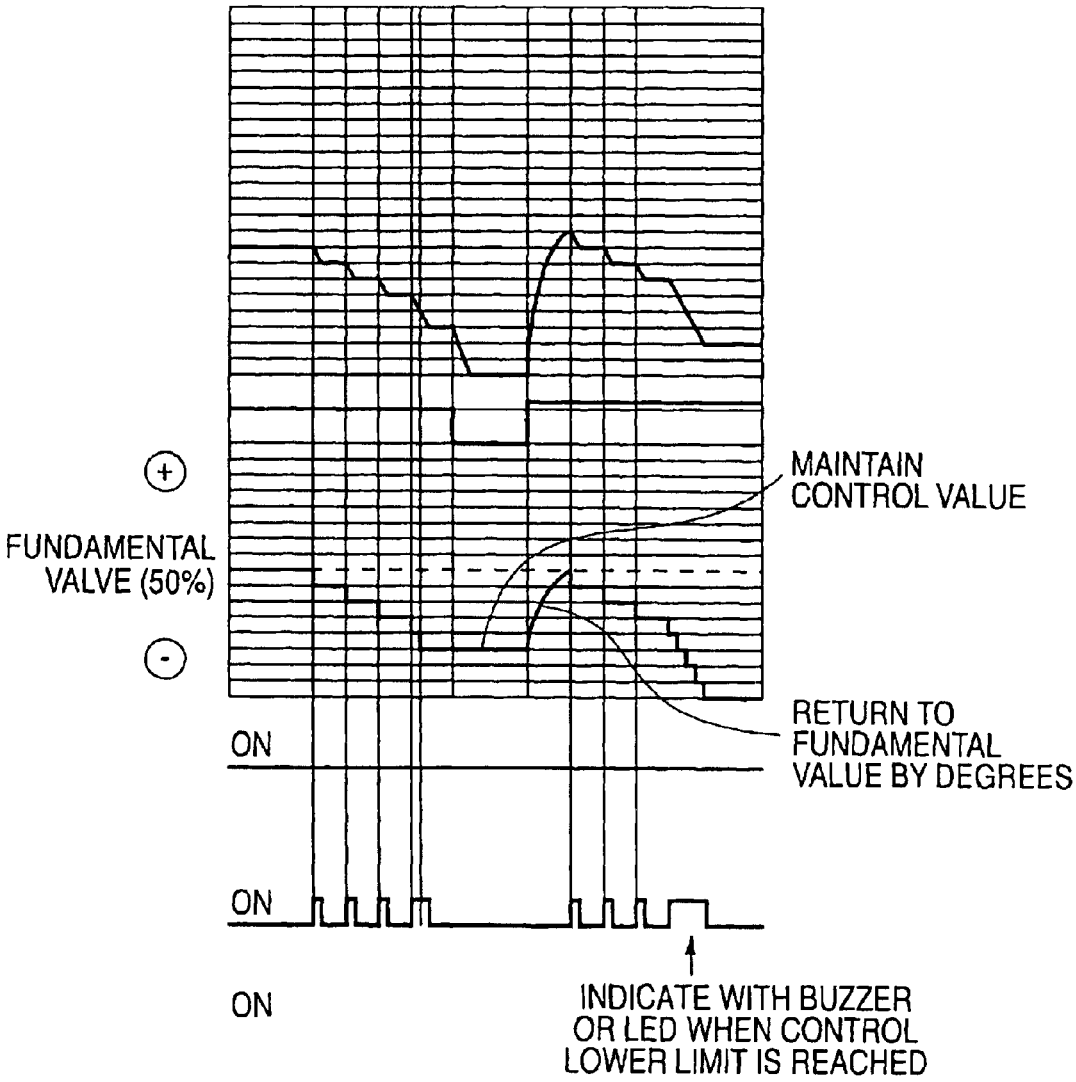
FIG. 9 is a diagram showing an example of a time chart resulting when the throttle is controlled and an air control value is gradually returned to a fundamental value in case the air control value is greater than the fundamental value while a control according to the embodiment is implemented.

FIGS. 7A, 9, 7B show an example for resolving the aforesaid drawbacks.

FIGS. 7A, 9: In case the throttle is controlled in the opening direction when the control value of the air control valve 14 is greater than the fundamental control volume (when the control value is controlled to be on a + side of the air control valve), the control value of the air control valve 14 is maintained, whereas in case the throttle is controlled in the closing direction, the control value is returned to the fundamental volume.

In addition, in case throttle is controlled in the opening direction when the control value of the air control valve 14 is smaller than the fundamental value (when the control value is controlled to be on a – side of the air control valve), the control value of the air control valve 14 is returned to the fundamental value, whereas in case the throttle is controlled in the closing direction, the control value is maintained.

Note that when the control value is returned to the fundamental volume, in case the control value (regulation and control volume) is returned to the fundamental volume drastically, the crew member who steers the boat is made to feel a physical disorder, and therefore, as shown in FIGS. 7A and 9, the control value is returned to the fundamental volume gradually.

In addition, as shown in FIG. 7B, in case the throttle control amount is greater than a fixed value and a change in air volume that results from the operation of the throttle is sufficiently greater than a change in air volume by the air control valve 14, the control value is returned to the fundamental value.

By these operations the engine speed regulating width can be secured without having to make the crew member who steers the boat feel a physical disorder.

Figure 10:
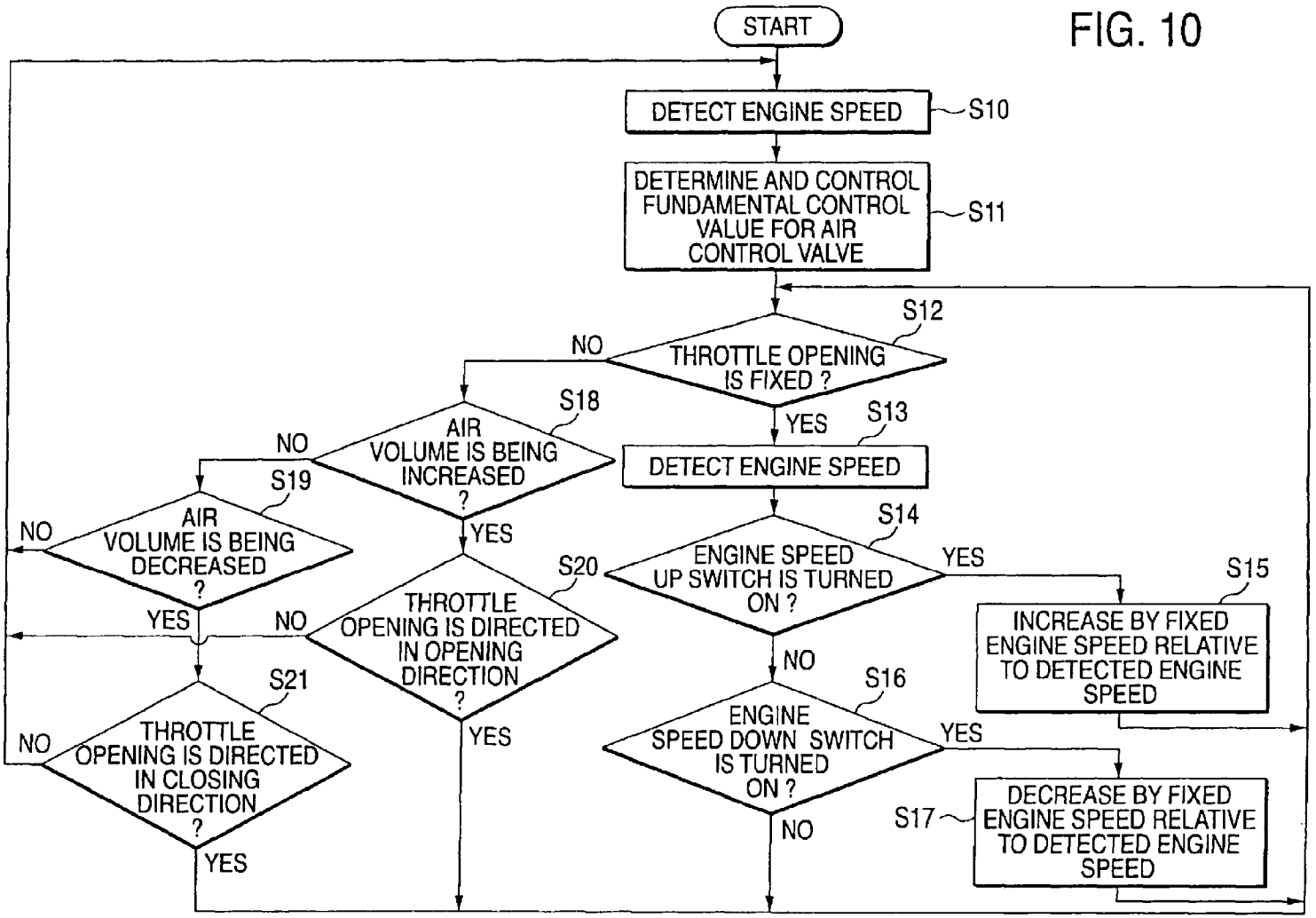
FIG. 10 is a flowchart of a control example 2 according to the embodiment.

A flowchart of the air control of which the contents have been described above is shown in FIG. 10.

Firstly, an engine speed is detected (S10), and a fundamental control volume for the air control valve 14 is determined and controlled (S11).

In case the control of the engine speed UP switch 44 is detected when the throttle is not controlled (Yes in S12), the air control valve 14 is opened while feeding back the engine speed until the engine speed increases by a fixed engine speed width relative to the engine speed so detected (S15).

On the contrary, in case the operation of the engine speed DOWN switch 45 is detected when the throttle is not controlled (Yes in S12), the air control valve is controlled to be closed while feeding back the engine speed until the engine speed decreases by the fixed engine speed width relative to the engine speed so detected (S17).

When the throttle is controlled (No in S12), whether the throttle opening is in the opening direction (S20) or in the closing direction (S21) and how the air control valve 14 is controlled (whether the air control valve 14 is controlled such that the control value thereof is increased or is controlled such that the control value thereof is decreased) are determined (S18 to S21). Then, in case the throttle is controlled in the opening direction (Yes in S20) when the control value of the air control valve 14 is greater than the fundamental volume, the control value of the air control valve is maintained (S12 to S15), whereas in case the throttle is controlled in the closing direction (No in S20), returning to the start, the control value is returned to the fundamental volume (S10). In this case, the control is implemented with a fundamental control value according to a fixed engine speed.

In addition, in case the throttle is controlled in the opening direction (No in Step 21) when the control value is smaller than the fundamental volume (when controlled to be on one side by the air control valve), returning to the start, the air control valve 14 is returned to the control value (S10), whereas in case the throttle is controlled in the closing direction (Yes in Step 21), the control value of the air control valve 14 is maintained.

Note that in case a sufficient regulating width cannot be obtained by a single air control valve 14, a plurality of air control valves 14 are provided, and a similar control can be implemented.

Figure 11A:
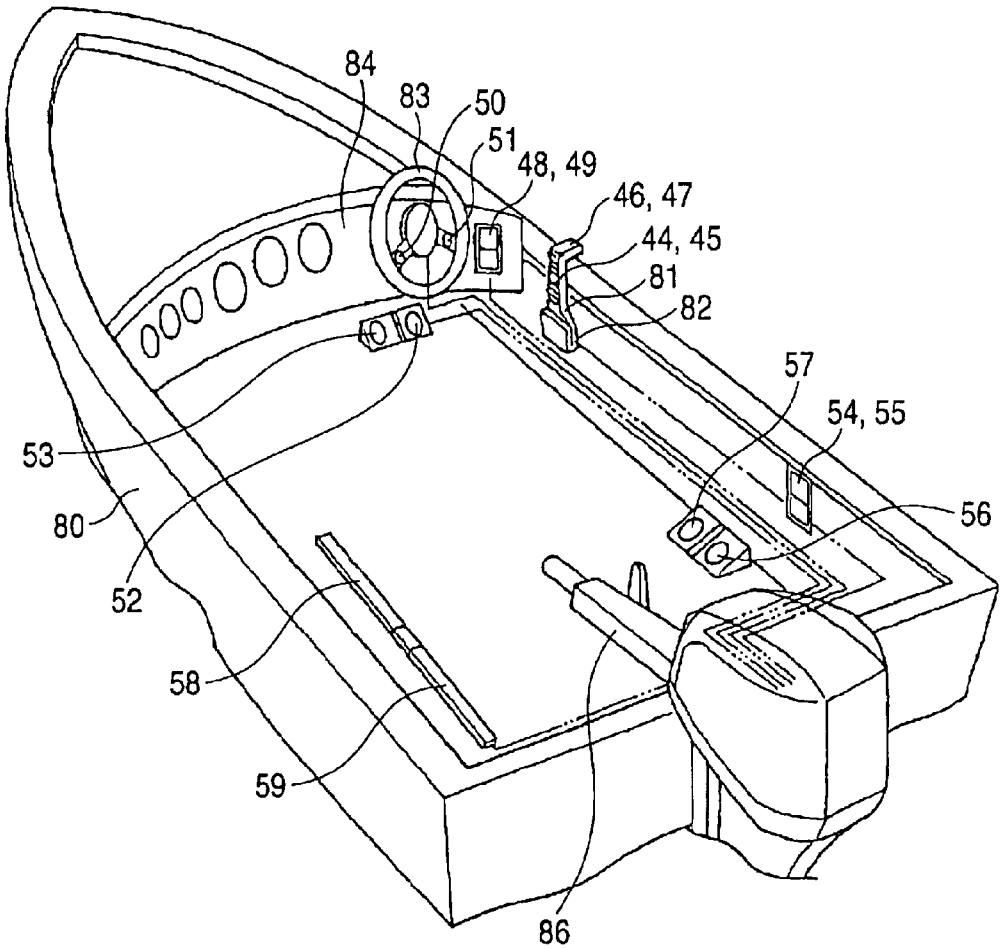
FIGS. 11A and 11B are explanatory views showing examples of locations of an engine speed operating unit, respectively.

Next, another embodiment of an engine speed operating unit will be described by which the crew member directly inputs an air increase or decrease signal into the control unit 36 for controlling the opening and closing of the air control valve 14. FIG. 11A shows an example in which respective switches of the engine speed operating unit are arranged at respective portions of the hull.

Figure 11B:
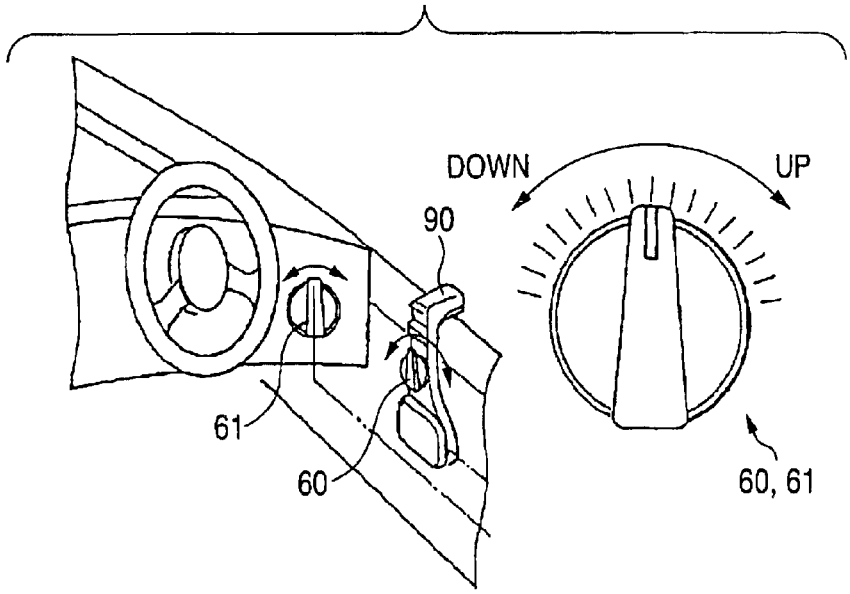

While the engine speed UP switch 44 and the engine speed DOWN switch 45 can be constituted by the seesaw type switch or push switch in the previous embodiment, the engine speed operating unit itself can, of course, be constituted by a control detector utilizing an analog type switch such as a variable resistor or a Hall element. FIG. 11B shows examples in which a control detector of this type is arranged in a remote control box 81 in which a throttle lever (a throttle operating unit) and an ignition key are provided and in which the control detector is arranged on a control panel. In FIG. 11B, a control detector unit 60 can be provided on a throttle lever 82 in a remote control box 81 provided on a side of the cockpit on a hull 80, and a control detector unit 61 can be provided on an instrument panel 84 in the vicinity of a steering wheel 83. Each of the control detector units 60, 61 is of a dial type and can be turned leftwards and rightwards. Either of the control detector units is such as to be turned to an ascent (UP) side and a descent (DOWN) side by the crew member who steers the boat, and a change in operating distance is detected and controlled by way of changes in resistance and voltage.

However, the following advantages are provided when the engine speed regulation control unit is constituted by the push switch.

The engine speed can easily be adjusted finely and held by fixing an increase and a decrease in volume and engine speed provided by a single operation of the push switch to a minute volume (a minute engine speed). In addition, a relatively large change in engine speed can also be attained easily by constructing the push switch such that when kept pushed continuously, the change continues to be increased.

In addition, since the push switch can provide a mode in which the engine speed and air volume are regulated by the number of times of pushing by fixing a change in engine speed and air volume by a single push rather than a mode in which the control unit is displaced by a distance corresponding to a desired engine speed and air volume (for example, a change in distance relative to a reference position of the control unit, refer to FIG. 11B), a fine adjustment can be made even from an unstable posture on the boat. Namely, the adjustment is not implemented through the displacement mode, the adjustment can be performed without having to pay attention to the reference position (without looking at the control unit). In addition, by devising the shape of the switch the adjustment by the foot can also be made possible, and therefore, the engine speed (boat speed) can be adjusted while the hands are used for certain work or steering the boat.

For example, while a continuous air regulation and control method which can correspond to a displacement in distance (in angle) of a control unit used for controlling the throttle of a two-wheeled vehicle, a four-wheeled vehicle or an outboard motor is suitable for a quick control of engine speed over a wide range, but when a minute change or adjustment in volume (engine speed) is attempted to be implemented by this method, the method is not suitable for maintenance at the location where it is controlled and adjusted. In the case of the two-wheeled vehicle or four-wheeled vehicle, when compared with the outboard motor, the vehicle rarely runs at a certain speed, and on the contrary, in most cases, the throttle needs to be controlled at all times as required by the condition of traffic. In contrast to this, in the case of a boat with an outboard motor, in most cases, the outboard motor is required to be controlled such that the boat speed (engine speed) is adjusted finely at relatively low and intermediate speeds and a speed so adjusted is maintained due to the nature of fishing work and trolling (fishing) and speed controls in ports and bays and on courses. Consequently, with the outboard motor, the minute control of the throttle valve opening tends to become difficult, and in addition to this, the necessity of the engine speed operating unit is high.

Figure 12A:
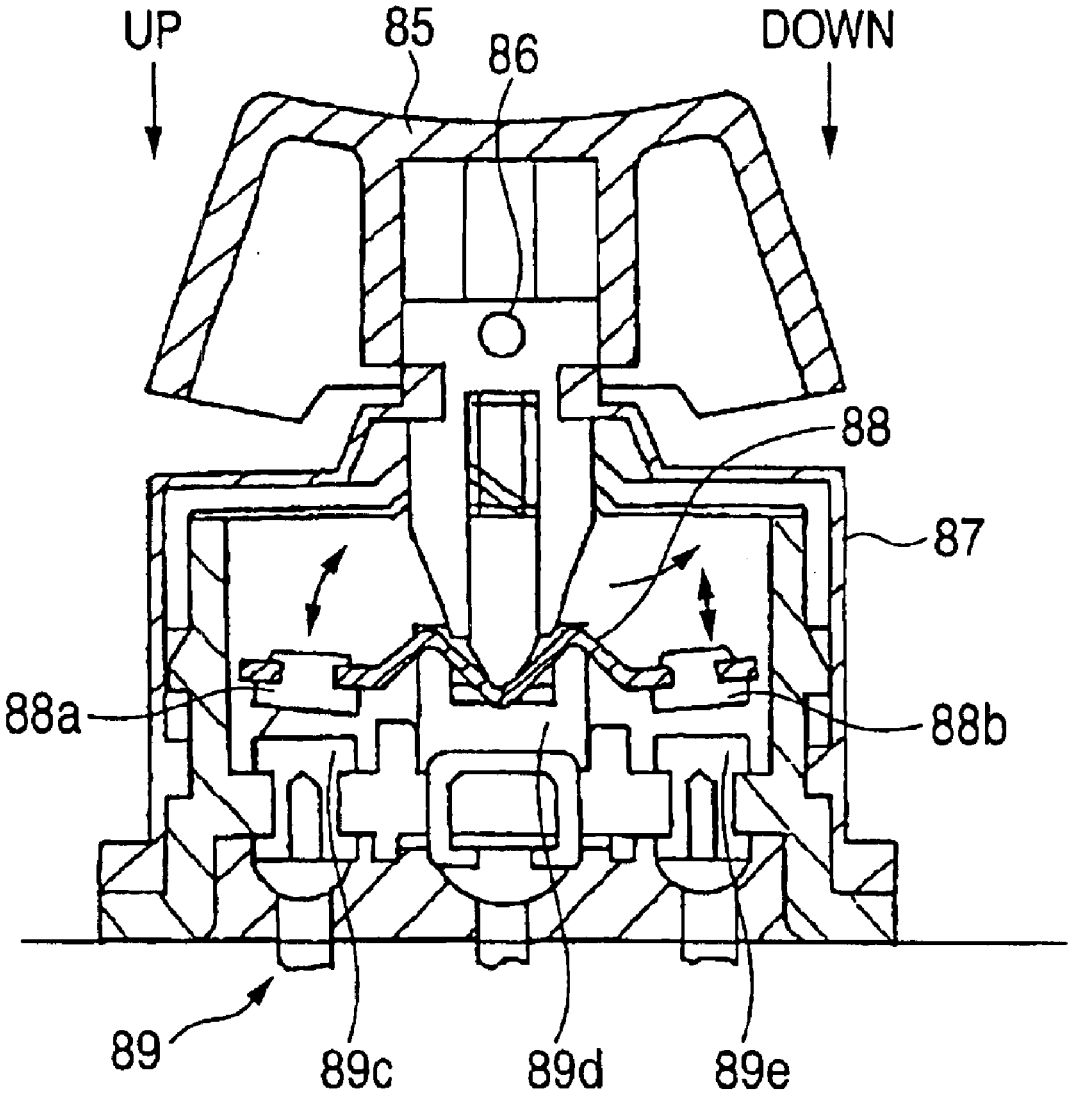
FIGS. 12A, 12B, 12C are explanatory views of a seesaw-type switch of the engine speed operating unit, FIG. 12A being a vertical sectional view, FIG. 12B being a plan view, FIG. 12C being a view as seen from the side.
Figure 12B:
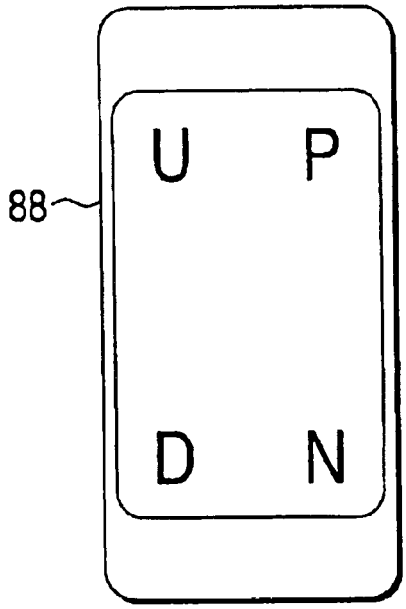
Figure 12C:
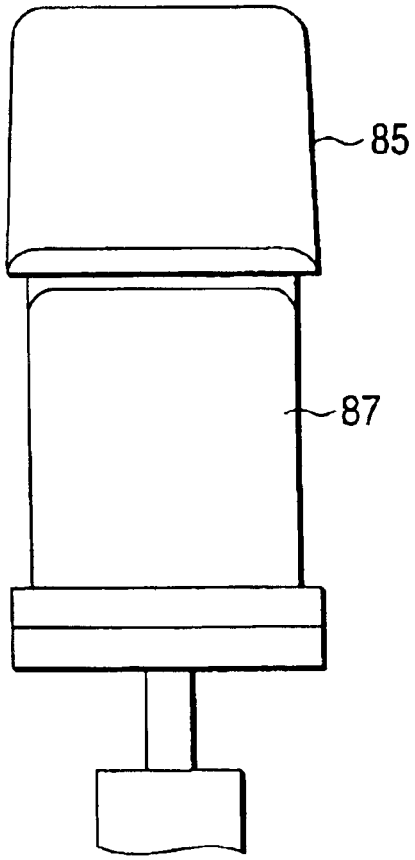

FIG. 12 shows an example of the construction of an engine speed regulation and control unit having a seesaw-type contact.

An engine speed operating unit shown in FIG. 12 is of a seesaw type and is constructed such that an arc-like operator pressing surface portion 85 swings on a shaft 86, and a support portion for a seesaw-type movable contact 88 extends within a case portion 87 which accommodates therein the contact. Fixed contacts 89 (89*c*, 89*d*, 89*e*) are provided in the case portion 87, and the contact 89*d* is neutral and is electrically connected to the movable contact 88. When the movable contact 88*a*, 88*b* is pushed to swing (seesaw) to an UP side, the movable contact 88*a* comes into contact with the fixed contact 89*c* to thereby output an UP signal, whereas when the movable contact is pushed to swing to a DOWN side, the movable contact 88*b* comes into contact with the fixed contact 89*e* to thereby output a DOWN signal.

In addition to the locations described above, the engine speed operating unit can be mounted to various locations such as the hull.

Figure 13:
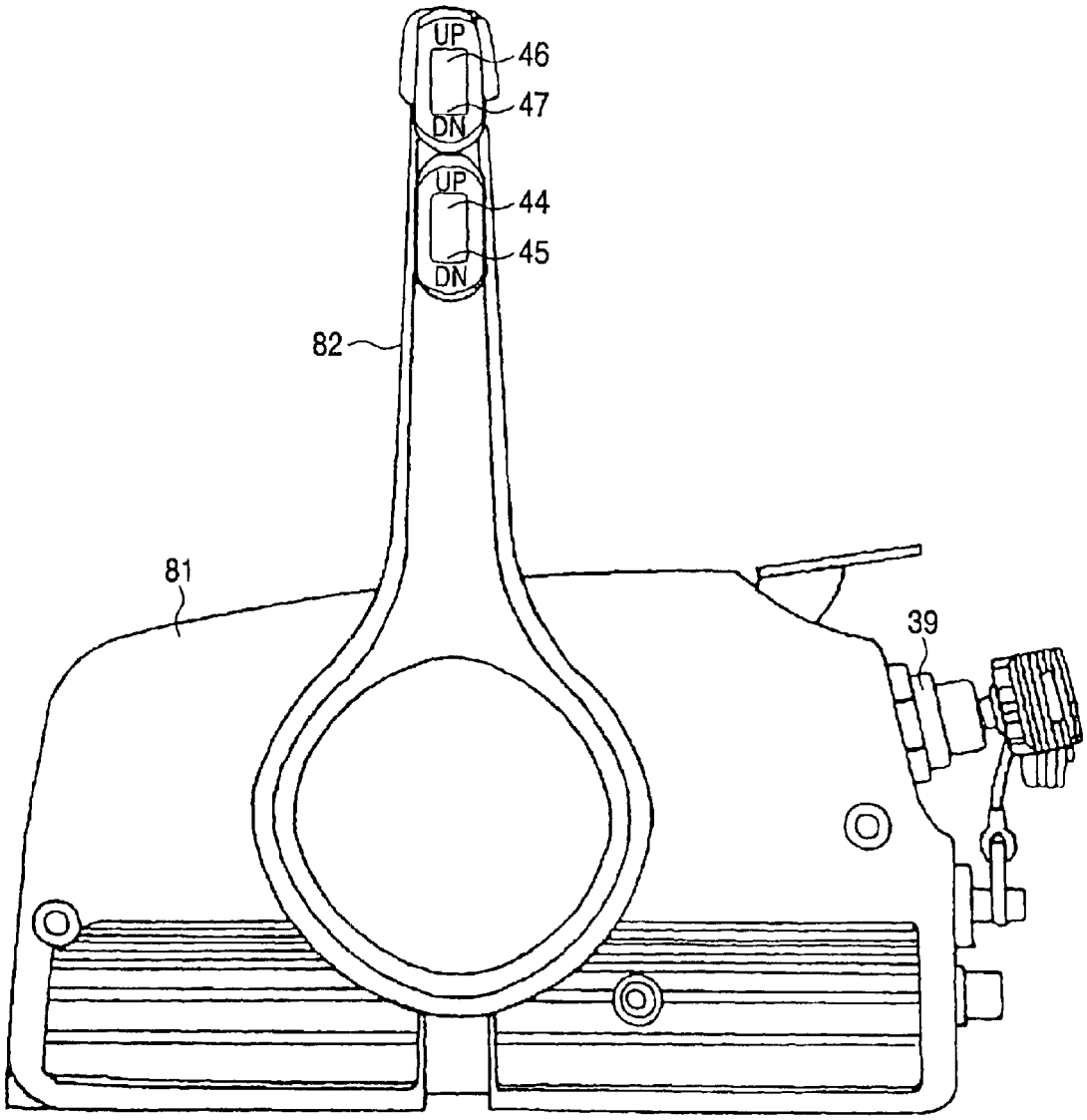
FIG. 13 is a diagram showing examples of locations of switches in a remote control box.
Figure 14A:
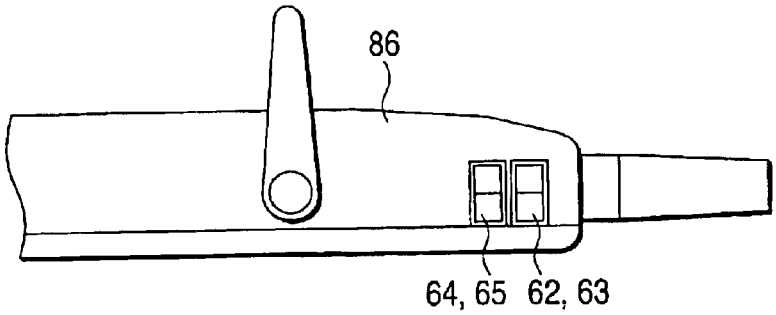
FIG. 14A is a diagram showing an example of a location of the engine speed operating unit in which the unit is disposed on a tiller handle.
Figure 14B:
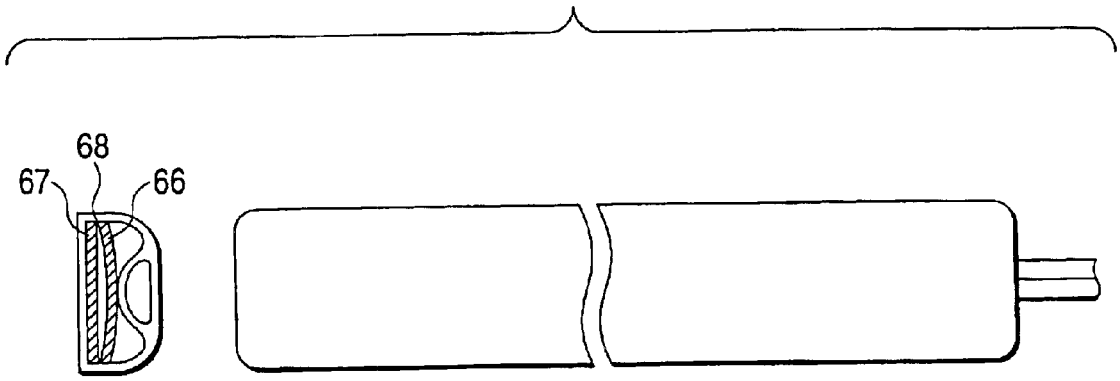
FIG. 14B is an explanatory diagram explaining the location of a pedal-type push switch.

The engine speed operating unit can be mounted to various locations as shown in FIGS. 11A, 13, 14. In FIG. 11A, an example is shown where engine speed operating units denoted by reference numerals 44, 45 are disposed below PTT switches 46, 47 of the throttle lever 82. In addition, engine speed operating units 48, 49 may be mounted on the instrument panel 84 of the hull 80, or engine speed operating units 50, 51 may be equipped in the vicinity of the steering wheel 83 on the hull 80.

In addition, the engine speed operating unit may be arranged on a floor portion of the hull 80 at locations indicated by reference numerals 52, 53, 56, 57, 58, 59 so that the crew member can operate the engine speed operating unit by the foot. As this occurs, the engine speed operating units denoted by reference numerals 58, 59 are constructed such that contacts 66, 67 and an insulator 68 are encapsulated in an elastic body such as a rubber member, whereby the rubber member 68 and the contact plate are deformed by virtue of a push (an external force) to thereby close the contact. A mat-type switch having a similar construction can be used.

In addition, the engine speed operating unit may be provided on a side of the hull.

In addition, as shown in FIG. 14A, engine speed operating units (denoted by reference numerals 64, 65) may be provided on a tiller handle 86 of the outboard motor in the vicinity of PTT switches 62, 63.

In addition to the mounting locations of engine speed operating units which are described above, the engine speed operating unit may be mounted on a front part of the outboard motor.

In a case where the engine speed operating unit is mounted in the vicinity of the throttle operating unit as shown in FIGS. 11A and 13, since the engine control unit is of a mode in which the throttle is controlled by the arm while the engine speed is finely adjusted by the finger in a normal remote control condition in which the grip of a remote controller is gripped by the hand, both operations such as fine adjustment and maintenance of the boat speed (engine speed), and acceleration and deceleration and engine speed adjustment over a wide range can freely be controlled by one of the hands without having to look at the remote control unit.

The location of the engine speed operating unit becomes effective, in particular, on the peripheries of the grip and the PTT switches, and the positional relationship between the engine speed controlling UP switch 44 and DOWN switch 45 is matched to that between the UP switch 46 and DOWN switch 47 of the PTT switch. In the example shown in FIG. 13, the engine speed operating unit in which the engine speed controlling UP switch 44 is disposed upwards and the engine speed controlling DOWN switch 45 is disposed downwards is mounted below the PTT switch in which the UP switch is disposed upwards and the DOWN switch is disposed downwards by using the same switch.

By arranging the switches as described above the construction becomes easy to be felt by sense, and the engine speed can easily be regulated by the tip of the finger without preventing the control of the throttle.

Apart from the examples described above, the engine speed operating unit can easily be fitted on the tiller handle, and the floor portion and the side of the hull. When it is installed on the floor portion, since the engine speed operating unit can easily be controlled (finely adjusted) by the tip of the foot, the boat speed can easily be adjusted to a desired boat speed even while various types of work is carried out or fishing tools (net, fishing rod) are used. In addition, the engine speed operating unit is constructed to be adjusted with a simple ON/OFF switch, the location of the engine speed operating unit is not limited to those shown in FIGS. 11 to 14 and the control switch can be disposed at various locations corresponding to various modes of usage.

According to the invention, the fine adjustment of the throttle can be implemented without having to adjust the throttle lever a plurality of times even if the cockpit on the hull and the outboard motor main body are located away from each other. With the outboard motor, since the throttle cable becomes long and is laid out in the hull while being bent, the sliding resistance is increased, whereby the find adjustment of the throttle opening is made difficult. According to the invention, however, the crew member who steers the boat can easily adjust the boat speed to a desired one by controlling the air volume by the air control valve through the separate system. With a boat with an outboard motor, the outboard motor is required to be controlled such that the boat speed (engine speed) is adjusted finely at relatively low and intermediate speeds and a boat speed so adjusted is maintained due to the nature of fishing work and trolling (fishing) and boat speed controls in ports and bays and on courses, and when this is required, according to the invention, the engine speed can be controlled at fine steps.

In addition, in case the engine speed operating unit is constructed to be a push-type unit, the fine adjustment can be attained even from an unstable posture on the boat. Since the push-type engine speed operating unit is not a dial-type unit using a rotating resistor in which the adjustment is implemented through the displacement of the dial, the fine adjustment of engine speed can be attained without having to pay attention to the reference position (without looking at the control unit). In addition, in case the shape of the switch is devised further, an adjustment by the foot can easily be attained, and therefore, the adjustment of engine speed (boat speed) can be attained even while the crew member is doing work needing his or her both hands or is steering the boat. Since the adjustment can be implemented with the simple ON/OFF switch, the control switch can be disposed at various locations according to various types of usage. In case the seesaw-type switch is used, there is caused no risk that both the UP and DOWN operations are implemented simultaneously, and hence the crew member who steers the boat can steer the boat easily, and the control becomes easy. In addition, in case the increases and decreases in air volume are fixed according to the number of times of controlling or, in particular, to the number of times of pushing, the fine adjustment of engine speed and maintenance of an engine speed so adjusted can be enabled. Furthermore, in case the volume of air is increased and decreased by the fixed volume, while an engine speed that is so increased and decreased differs depending on outputs and loads (the weight of the hull, the resistance of the structure, the size of the propeller), since the engine speed is increased and decreased by the fixed volume relative to a pushing operation by feeding back the engine speeds, a desired increase and decrease in engine speed can easily be attained irrespective of outputs and loads.

The crew member who steers the boat can easily recognize the controllable range of the engine speed operating unit by the disposition of the alarm unit.

In addition, in case the engine speed operating unit is of such a type in which the control volume is restored to the fundamental control volume when the throttle is controlled, the adjusting widths on the engine speed UP side and DOWN side can be secured after the throttle is controlled. Since in case the adjustment volume is drastically returned to the fundamental value, the change in engine speed becomes large, and the crew member who steers the boat is made to feel a physical disorder, the adjustment volume is preferably returned to the fundamental control value by degrees.

When the control volume is reset to the fundamental control volume also in the event that the throttle is opened by a minute amount after it has been adjusted several times to the engine speed UP side, since the volume of air that is decreased by resetting the air control valve is larger than the volume of air that is increased by opening the throttle, there is caused the drawback that the engine speed continues to be decreased irrespective of the opening of the throttle, whereby the crew member who steers the boat is made to feel a great physical disorder. In contrast, when the control volume is reset to the fundamental control volume also in the event that the throttle is closed by a minute amount after it has been adjusted several times to the engine speed DOWN side, since the volume of air that is increased by resetting the air control valve 14 is larger than the volume of air that is decreased by closing the throttle, there is caused the drawback that the engine speed continues to be increased irrespective of the closing of the throttle, whereby the crew member who steers the boat is made to feel a great physical disorder. To deal with these drawbacks, in case the throttle valve is controlled in the opening direction in the state in which the air control value of the air control valve is greater than the fundamental control value, it is appropriate to maintain the air control value of the air control valve, whereas in case the throttle valve is controlled in the closing direction, it is appropriate to return the control value to the fundamental control value, whereby the adjusting widths on the engine speed UP side and DOWN side can be secured without having to trouble the crew member who steers the boat.

When the throttle control amount is greater than the fixed value and the volume of air that is changed by the control of the throttle is greater than the volume of air that can be changed by the air control valve, the adjusting widths on the engine speed UP side and DOWN side can be secured without having to make the member crew who steers the boat feel a physical disorder by returning the control value to the fundamental control value.

The engine speed operating unit may be constituted by a switch of any other type than the push-type switch.

The engine speed operating unit takes the form in which the fine adjustment of engine speed can be implemented by the finger during a normal remote control operation in which the throttle grip is gripped by the hand, whereby both operations such as fine adjustment and maintenance of the boat speed (engine speed), and acceleration and deceleration and engine speed adjustment over a wide range can freely be controlled by one of the hands without having to look at the remote control unit. In fishery work, there are lots of jobs needing to use the both hands, and therefore since the boat speed can be adjusted finely by the foot, the work efficiency can be enhanced.

What is claimed is:

1. An outboard motor comprising:

an outboard motor main body accommodating therein an engine;

a throttle operating unit for operating an opening of a throttle valve to control a volume of intake air to the engine, the throttle operating unit being positioned away from said outboard motor main body in a hull;

a throttle wire for mechanically transmitting an operating input of the throttle operating unit to the throttle valve of the engine so as to drive said throttle valve to be opened and closed;

an electric air control valve for increasing and decreasing the volume of intake air to said engine via a separate system from said throttle valve; and a control unit including an actuator for controlling the opening and closing of said air control valve, and an engine speed operating unit for directly inputting an air increase or decrease signal inputted by a user into said control unit, wherein said engine speed operating unit is adapted to control the increase and decrease in air volume through an operation time or the number of times of pushing.

2. An outboard motor as set forth in claim 1, wherein said engine speed operating unit is a push switch for outputting an air increase or decrease signal through a pushing operation.

3. An outboard motor as set forth in claim 1, wherein said control unit restores said air control valve to a predetermined fundamental control value when said throttle valve is controlled by said throttle operating unit.

4. An outboard motor as set forth in claim 1, wherein an air control value of said air control valve is maintained when said throttle valve is controlled in an opening direction in a state in which said air control value of said air control valve is greater than said fundamental control value, whereas said air control value is returned to said fundamental control value when said throttle valve is controlled in a closing direction.

5. An outboard motor as set forth in claim 1, wherein said air control value of said air control valve is returned to said fundamental control value when an amount of a throttle control is greater than a predetermined value and a change in amount of air by said throttle control is greater than a change in amount of air that is attained by said air control valve.

6. An outboard motor as set forth in claim 1, wherein said engine speed operating unit is adapted to output an air increase or decrease signal utilizing a displacement detection sensor.

7. An outboard motor as set forth in claim 6, wherein said displacement detection sensor is a variable resistor.

8. An outboard motor as set forth in claim 1, wherein said engine speed operating unit is disposed in the vicinity of said throttle operating unit of a throttle lever.

9. An outboard motor as set forth in claim 1, wherein said engine speed operating unit is disposed at an appropriate location on said hull or said outboard motor.

10. An outboard motor comprising:

an outboard motor main body accommodating therein an engine;

a throttle operating unit for operating an opening of a throttle valve to control a volume of intake air to the engine, the throttle operating unit being positioned away from said outboard motor main body in a hull;

a throttle wire for mechanically transmitting an operating input of the throttle operating unit to the throttle valve of the engine so as to drive said throttle valve to be opened and closed;

an electric air control valve for increasing and decreasing the volume of intake air to said engine via a separate system from said throttle valve;

a control unit including an actuator for controlling the opening and closing of said air control valve, and an engine speed operating unit for directly inputting an air increase or decrease signal inputted by a user into said control unit; and an alarm unit to notify when a control signal inputted from said engine speed operating unit exceeds a control range set for said air control valve.

11. An outboard motor as set forth in claim 10, wherein said engine speed operating unit is a push switch for outputting an air increase or decrease signal through a pushing operation.

12. An outboard motor as set forth in claim 10, wherein said control unit restores said air control valve to a predetermined fundamental control value when said throttle valve is controlled by said throttle operating unit.

13. An outboard motor as set forth in claim 10, wherein an air control value of said air control valve is maintained when said throttle valve is controlled in an opening direction in a state in which said air control value of said air control valve is greater than said fundamental control value, whereas said air control value is returned to said fundamental control value when said throttle valve is controlled in a closing direction.

14. An outboard motor as set forth in claim 10, wherein said air control value of said air control valve is returned to said fundamental control value when an amount of a throttle control is greater than a predetermined value and a change in amount of air by said throttle control is greater than a change in amount of air that is attained by said air control valve.

15. An outboard motor as set forth in claim 10, wherein said engine speed operating unit is adapted to output an air increase or decrease signal utilizing a displacement detection sensor.

16. An outboard motor as set forth in claim 15, wherein said displacement detection sensor is a variable resistor.

17. An outboard motor as set forth in claim 10, wherein said engine speed operating unit is disposed in the vicinity of said throttle operating unit of a throttle lever.

18. An outboard motor as set forth in claim 10, wherein said engine speed operating unit is disposed at an appropriate location on said hull or said outboard motor.

* * * * *